US012578125B2

(12) United States Patent
Fitger et al.

(10) Patent No.: US 12,578,125 B2
(45) Date of Patent: Mar. 17, 2026

(54) METHOD FOR THE STABILISATION AND/OR OPEN-LOOP AND/OR CLOSED-LOOP CONTROL OF A WORKING TEMPERATURE, HEAT EXCHANGER UNIT, DEVICE FOR TRANSPORTING ENERGY, REFRIGERATING MACHINE AND HEAT PUMP

(71) Applicant: Fraunhofer-Gesellschaft zur Förderung der angewandten Forschung e.V., Munich (DE)

(72) Inventors: Andreas Fitger, Freiburg (DE); Andreas Mahlke, Freiburg (DE); Nora Bachmann, Freiburg (DE); Patrick Corhan, Freiburg (DE); Lena Maria Maier, Freiburg (DE); Kilian Bartholomé, Freiburg (DE); Olaf Schäfer-Welsen, Freiburg (DE)

(73) Assignee: Fraunhofer-Gesellschaft zur Förderung der Angewandten Forschung e.V., Munich (DE)

( * ) Notice: Subject to any disclaimer, the term of this patent is extended or adjusted under 35 U.S.C. 154(b) by 747 days.

(21) Appl. No.: 17/796,792

(22) PCT Filed: Feb. 3, 2021

(86) PCT No.: PCT/EP2021/052529

§ 371 (c)(1),
(2) Date: Dec. 20, 2022

(87) PCT Pub. No.: WO2021/156298

PCT Pub. Date: Aug. 12, 2021

(65) Prior Publication Data

US 2023/0137699 A1 May 4, 2023

(30) Foreign Application Priority Data

Feb. 6, 2020 (EP) ..... 20155864

(51) Int. Cl.
*F25B 21/00* (2006.01)
*F25B 25/00* (2006.01)

(52) U.S. Cl.
CPC ..... *F25B 21/00* (2013.01); *F25B 25/005* (2013.01); *F25B 2321/001* (2013.01); *F25B 2321/002* (2013.01)

(58) Field of Classification Search
None
See application file for complete search history.

(56) References Cited

U.S. PATENT DOCUMENTS 10,948,222 B2 * 3/2021 Zerovnik ..... F25B 25/005
11,598,561 B2 * 3/2023 Mantese ..... F25B 21/00
(Continued)

FOREIGN PATENT DOCUMENTS

BR 112017000350 B1 * 10/2022 ..... F25B 21/00
CN 201348396 11/2009
(Continued)

*Primary Examiner* — Jenna M Maroney
(74) *Attorney, Agent, or Firm* — Volpe Koenig

(57) ABSTRACT

A method for stabilization and/or control and/or regulation of the working temperature of a cyclic-process-based system having at least one heat-exchanger unit with at least one calorically active material element. It is essential that a base temperature of the calorically active material element (11, 12) is controlled by a cooling fluid. A heat-exchanger unit, a refrigeration machine, and a heat pump according to this are also provided.

21 Claims, 5 Drawing Sheets

(56) References Cited

U.S. PATENT DOCUMENTS

| | | | | |
|---|---|---|---|---|
| 2008/0314048 | A1 | 12/2008 | Barve et al. | |
| 2011/0314836 | A1* | 12/2011 | Heitzler | F25B 21/00 62/3.1 |
| 2012/0272665 | A1 | 11/2012 | Watanabe et al. | |
| 2015/0362224 | A1 | 12/2015 | Benedict et al. | |
| 2018/0238594 | A1* | 8/2018 | Mantese | F25B 21/00 |
| 2019/0264958 | A1* | 8/2019 | Zerovnik | F25B 23/00 |
| 2020/0217572 | A1* | 7/2020 | Shafir | F25B 6/04 |
| 2021/0180838 | A1* | 6/2021 | Eastman | F25B 49/00 |

FOREIGN PATENT DOCUMENTS

| | | | | |
|---|---|---|---|---|
| CN | 102345942 | | 2/2012 | |
| CN | 108603704 | | 9/2018 | |
| CN | 108679875 | | 10/2018 | |
| DE | 102014010476 | | 12/2015 | |
| DE | 102015221322 | | 5/2017 | |
| DE | 102015121657 | | 6/2017 | |
| DE | 112018000412 | | 10/2019 | |
| TW | 200846610 | | 12/2008 | |
| WO | WO-0186218 | A2 * | 11/2001 | F25J 1/001 |
| WO | WO-2008094058 | A2 * | 8/2008 | F02G 1/04 |

* cited by examiner

METHOD FOR THE STABILISATION AND/OR OPEN-LOOP AND/OR CLOSED-LOOP CONTROL OF A WORKING TEMPERATURE, HEAT EXCHANGER UNIT, DEVICE FOR TRANSPORTING ENERGY, REFRIGERATING MACHINE AND HEAT PUMP

TECHNICAL FIELD

The invention relates to a method for stabilization and/or control and/or regulation of the working temperature of a cyclic-process-based system, to a heat-exchanger unit for a cyclic-process-based system, to a device for transporting energy, to a cooling device, and to a heat pump.

BACKGROUND from the prior art, it is known to use in cyclic-process-based systems such as refrigeration machines, heat pumps or heat engines calorically active material, which changes its temperature in interaction with a corresponding field. For example, DE 10 2014 010 476 B3 describes an air-conditioning device on the basis of a heat pipe with calorically active material, in this case magnetocaloric material. Also, DE 10 2015 121 657 A1 has disclosed a method for operating cyclic-process-based systems using mechanocaloric material.

Here, cyclic processes are known from the field of thermodynamics as a sequence of periodic changes in state of a working fluid, which pass through an initial state at regular intervals. Examples of such cyclic processes are heating and/or cooling through the use of work, such as for example in heat pumps or refrigeration machines, or else conversion of heat into work, such as for example in heat engines.

As has already been stated, it is known from the prior art to use calorically active materials in such cyclic processes. Such calorically active materials change their temperature in the region of influence of a correspondingly suitable field. The expression "calorically active materials" encompasses for example electrocaloric materials, magnetocaloric materials and mechanocaloric material.

Electrocaloric materials change their temperature in the region of influence of an electric field owing to the orientation of the electric moments and the associated reduction in entropy or a crystal-lattice transformation between a ferroelectric phase and a paraelectric phase. Magnetocaloric materials change their temperature in the region of influence of an electric field owing to the orientation of the magnetic moments and the associated reduction in entropy or a crystal-lattice transformation between a ferromagnetic phase and a paramagnetic phase. Mechanocaloric materials (also known as elastocaloric materials, barocaloric materials or shape-memory alloys) undergo a crystalline phase transition as a result of the application of a mechanical stress, which phase transition gives rise to a change in temperature of the material. This normally involves a crystal-lattice transformation between a high-temperature phase (austenite) and a low-temperature phase (martensite).

The described effects in the case of calorically active materials are normally reversible and function also in reverse: In the case of mechanocaloric materials, a change in temperature can correspondingly induce a change in shape and/or volume of the material. In the case of magnetocaloric materials, a change in temperature can correspondingly induce a change from the ferromagnetic phase into the paramagnetic phase, or vice versa, in the material. In the case of electrocaloric materials, a change in temperature can correspondingly induce a change from the ferromagnetic phase into the paramagnetic phase, or vice versa, in the material.

Therefore, in cyclic-process-based systems, calorically active materials may be used for transport and/or conversion of energy or heat. In this respect, it is known from the prior art that heat transfer via sensible heat, in particular via pumping of liquids, to discharge heat is relatively lossy and it is thus not possible to achieve a satisfactory efficiency or power density of the systems. It is rather the case that the heat is transferred by means of latent heat. Here, the calorically active material is typically arranged as a heat exchanger in a fluid circuit in connection with a hot-side reservoir and with a cold-side reservoir. The heat transfer between fluid and heat exchanger takes place by means of latent heat. The effectiveness of the heat transport is significantly increased in comparison with systems that operate with pumps through the realization of the heat transport by means of latent heat (that is to say evaporation heat and condensation heat of the working fluid).

In order to increase the efficiency of the systems, the calorically active material is cyclically heated and cooled. Here, the rate of heat flow ideally increases linearly with the cycle frequency. The heat flow is directed via thermal diodes, which are designed as active or passive fluid valves. The use of passive check valves is known.

Here, although the process that the calorically active material undergoes is in principle reversible, in reality all the calorically active materials exhibit self-heating, for example through hysteresis effects, during cyclic operation. This results in the loss of field energy, which is converted into heat and on average heats the caloric material, during each phase conversion. Self-heating encompasses for example the already mentioned hysteresis effects, in particular in the case of mechanocaloric materials, but also friction or, in particular in the case of electrocaloric, magnetocaloric and multicaloric materials, inductive heating, capacitive heating and/or resistive heating, which is induced by charging and/or eddy currents, generated by way of the field change, both in the calorically active materials and in other elements and thus directly or indirectly heats the calorically active material elements. The base temperature of the calorically active material, that is to say temperature without field application, increases.

A disadvantage of the already known devices and methods from the prior art is that the base temperature of the calorically active material increases owing to the self-heating described. With this material heating, the working temperature is shifted away from an ideal operating temperature of the calorically active material as the operating duration increases. Heat remaining in the calorically active material element, and an associated increase in temperature in the calorically active material element, presents an obstacle with regard to efficiently increasing the operating frequency of the already known systems.

SUMMARY

It is therefore the object of the present invention to propose a method for operating cyclic-process-based systems, a heat-exchanger unit and a device, which exhibit increased efficiency in comparison with already known devices and methods.

Said object is achieved by a method for temperature stabilization and/or control and/or regulation having one or more of the features disclosed herein, and also by a heat-exchanger unit having one or more of the features disclosed herein, and a device for transporting energy v. Preferred configurations of the method according to the invention are found below and in the claims. Preferred configurations of the heat-exchanger unit according to the invention are found below and in the claims. Furthermore, the object according to the invention is achieved by a cooling device and by a heat pump, each having one or more of the features disclosed herein.

The method according to the invention is preferably configured for being carried out by means of the devices according to the invention and/or by means of a preferred embodiment of the devices. The devices according to the invention are preferably configured for carrying out the method according to the invention and/or a preferred embodiment of the method according to the invention.

The method according to the invention for stabilizing and/or controlling the working temperature of a cyclic-process-based system is, as is known per se, carried out by way of a cyclic-process-based system having a heat-exchanger unit with calorically active material.

It is essential that a base temperature of the calorically active material element is controlled by means of a cooling fluid.

The invention is based on the realization by the applicant that, through stabilization of the base temperature or control and/or regulation to a desired base temperature, the efficiency of cyclic-process-based systems having a heat-exchanger unit with calorically active material can be increased significantly.

In the context of the present description, the expression "calorically active material element" is to be understood as meaning an element partly or completely composed of calorically active material. The calorically active material element may be designed as a heat exchanger.

In the context of the present description, the base temperature is a desired working temperature of the calorically active material, that is to say the desired temperature without field application.

The method is suitable for the transport of energy by way of a refrigeration machine as well as for the transport of energy by way of a heat pump as well as for the conversion of heat into energy in a heat engine. Mechanocaloric, electrocaloric or magnetocaloric materials may be used as calorically active material.

The method according to the invention for operating cyclic-process-based systems is carried out by way of a cyclic-process-based system having a hot-side reservoir and having a cold-side reservoir and having at least one fluid chamber for a working fluid. The system is designed with an evaporator region and a condenser region for a working fluid and has at least one heat-exchanger unit with at least one calorically active material element, wherein the calorically active material is arranged in the fluid chamber so as to be indirectly or directly operatively connected to the working fluid and a heat transfer between the calorically active material of the calorically active material element and the working fluid takes place by means of latent heat transfer.

The method comprises the following steps:

A activation of an electric field and/or magnetic field and/or mechanical stress field such that the calorically active material is at least temporarily subjected to interaction with the stated electric field and/or magnetic field and/or mechanical stress field;

B evaporation of the working fluid through heating of the calorically active material by way of a first change in temperature, induced in method step A, of the calorically active material to above a base temperature;

C discharge of the working fluid to the hot-side reservoir and condensation of the working fluid in the condenser region, wherein heat transport is realized by means of latent heat of the evaporated working fluid;

D return transport of the condensed working fluid from the condenser region to the evaporator region;

E deactivation of the electric and/or magnetic and/or elastic field;

F second, opposite change in temperature of the calorically active material to below the base temperature;

G feeding of the working fluid from the cold-side reservoir into the fluid chamber, wherein heat transport from the evaporator region into the fluid chamber is realized by means of latent heat of the evaporated working fluid.

It is essential that the base temperature of the calorically active material element is controlled or regulated by means of a cooling fluid.

This yields the advantage that the heat generated or input in the calorically active material can be discharged from the calorically active material. Thus, the calorically active material is stably kept at a base temperature, which preferably corresponds to the ideal working temperature of the calorically active material.

Furthermore, it is also possible to not only maintain a base temperature of the calorically active material element. Rather, it is possible, by means of the cooling fluid, for the working temperature, that is to say a selected target base temperature, of the calorically active material element to be set. The temperature variations owing to the field application with respect to the calorically active material then vary about the target base temperature.

Calorically active materials exhibit an ideal working temperature (target base temperature, base temperature) according to material. Caloric materials have a limited temperature range in which the caloric effect occurs. This temperature band is known as working window. The working window is normally very wide in the case of electrocaloric and mechanocaloric materials (typically up to 100 K) and very narrow in the case of magnetocaloric materials (typically a few kelvins). The position of the working window is substantially material-dependent and can be set via the material composition or the alloy constituents. The invention yields the advantage that the working temperature of the process can be set in a targeted manner.

In a preferred embodiment of the invention, the method is repeated, in particular repeated multiple times, preferably cyclically at a frequency of greater than 1 Hz, particularly preferably at a frequency of greater than 10 Hz, preferably at a frequency of between 1 Hz and 100 Hz.

In a further preferred embodiment of the invention, the method is carried out by way of a cyclic-process-based system having multiple fluid chambers, in particular having multiple fluid chambers connected in series. The working fluid flows through the fluid chambers connected in series. Since the temperature of the working fluid changes with each fluid chamber, it is expedient for the calorically active material of the fluid chambers to be adapted to the respective temperature of the working fluid. Such a method and such a device are described for example in DE 10 2015 121 657 A1. Reference is made in full here to this embodiment.

Alternatively, multiple fluid chambers may be connected in parallel. Such an arrangement of fluid chambers connected in parallel may be used in devices for heat recuperation.

Normally, at least one hot-side valve is provided between hot-side reservoir and fluid chamber and at least one cold-side valve is provided between cold-side reservoir and fluid chamber. The valves preferably act as passive valves and allow the operation of the system as thermal diode, that is to say with directed heat transport. As described, the system is designed with an evaporator region and a condenser region for the working fluid. The evaporator region and condenser region may be designed as separate regions, preferably in the form of the hot-side reservoir and cold-side reservoir. It is however also possible for independent regions to be provided. In particular in the case of multiple fluid chambers connected in series, the calorically active material of a heat-exchange unit acts as evaporator region and as condenser region. The fluid flows in vapor form into the fluid chamber from the cold-side reservoir or from a fluid chamber connected upstream and condenses on the heat-exchanger unit composed of calorically active material. By way of the heating of the calorically active material, the condensed fluid evaporates, the pressure in the fluid chamber increases and the fluid flows via the hot-side valve into the next fluid chamber in order, there, to again condense on the heat-exchanger unit composed of calorically active material. By way of this repeated process, the fluid passes through all the fluid chambers connected in series up to the hot-side reservoir. From there, the fluid is returned to the cold-side reservoir via the fluid return.

In a preferred embodiment of the invention, by means of the cooling fluid, the base temperature of the calorically active material element is adapted to an ideal working temperature for the calorically active material. In particular if a plurality of fluid chambers are connected in series or parallel, it is advantageous for the base temperature of each calorically active material element of the fluid chambers connected in series to in each case be adapted to an ideal working temperature for the calorically active material of the respective fluid chamber. The directed heat transport results in the working fluid changing its temperature as it passes through the fluid chambers. The control or regulation of the base temperature of the respective calorically active material element makes it possible for the system efficiency to be improved significantly.

In a further preferred embodiment of the invention, the fluid circuit for the working fluid and the fluid circuit for the cooling fluid run in a spatially separated manner, in particular the working fluid and the cooling fluid circulate in two separate fluid circuits.

This yields the advantage that, when selecting the cooling fluid, the selection is not limited to the fluid in the working-fluid circuit. The fluid in the working-fluid circuit may be selected independently of the fluid in the cooling-fluid circuit. Furthermore, in the working-fluid circuit, the parameter of pressure and/or of temperature can be set independently of the working-fluid circuit.

In a preferred realization of the invention, the cooling fluid is conducted through the calorically active material element with calorically active material. Preferably, the cooling fluid is conducted through at least one channel in the calorically active material element. This yields the advantage that, in a simple manner, cooling fluid and calorically active material of the calorically active material element can be brought into operative connection such that thermal contact arises and the heat is discharged from the calorically active material. Here, the separation of cooling fluid within the channel of the calorically active material element and working fluid on an outer surface of the calorically active material element is ensured.

In an alternative embodiment of the invention, the working fluid is used as cooling fluid. Particularly preferably, the fluid return of the working fluid from the hot-side reservoir to the cold-side reservoir may be used for this purpose.

Preferably, the calorically active material is exposed to an electric field and/or magnetic field and/or mechanical stress field, wherein the elastic field is generated in the calorically active material in the form of a mechanical stress, preferably by way of a tensile and/or compressive loading of the calorically active material, a shear and/or a compression of the calorically active material, wherein the tensile and/or compressive loading of the calorically active material causes a change in temperature of the calorically active material, and/or the electric field is generated by means of an electrical capacitor, wherein the electric field causes a change in temperature of the calorically active material, and/or the magnetic field is generated by means of a permanent magnet, preferably by means of a movable permanent magnet, wherein the magnetic field causes a change in temperature of the calorically active material. In this way, the caloric effect can be induced in a simple manner.

Preferably, a transport means for the working fluid and/or the cooling fluid, in particular in the form of a compressor, is driven by way of a stroke arising from the means for generating the mechanical stress field.

In this way, energy from the generation of the mechanical stress field can be used for driving or for transporting cooling fluid and/or working fluid.

In order for drying-out of the cold-side reservoir to be avoided, since, for the directed heat transport, the working fluid is transported from the cold-side reservoir, as evaporator, toward the hot-side reservoir, as condenser, there is normally provided in cyclic-process-based systems with calorically active materials a fluid return from the hot-side reservoir back to the cold-side reservoir. The fluid condenses in the condenser region on the hot side, and is returned to the cold-side reservoir by means of the fluid return. If, when being conducted from the hot-side reservoir back to the cold-side reservoir, the working fluid is conducted past the calorically active material element or preferably through the heat-exchanger unit, the working fluid may be used as cooling fluid. Cooling fluid and calorically active material can in this way be brought into operative connection.

Here, it likewise falls within the scope of the invention for hot-side reservoir and cold-side reservoir to be swapped and/or for the fluid return to lead in the other thermal direction. The principle of the fluid return can be used as temperature regulation according to the invention for the cooling fluid irrespective of direction and temperature difference.

The use of the working fluid as cooling fluid yields the advantage that the calorically active material element can be cooled in a simple manner by way of already existing means.

It likewise falls within the scope of the invention for the calorically active material element not to be cooled, but rather for a desired temperature to be set, or for regulation to a desired temperature to be realized, in a targeted manner by means of the cooling fluid. The use of the term "cooling fluid" and the use of the expression "cooling" are merely simplifications. What is meant here within the scope of the invention is that any desired base temperature is set. Also included here within the scope of the invention is that the calorically active material of a fluid chamber is heated to a desired base temperature, in particular the ideal working temperature.

In an alternative preferred embodiment of the invention, provision is made of a fluid connection from the cold-side reservoir, which fluid connection conducts cooling fluid from the cold-side reservoir through the calorically active material element, or past the calorically active material element, such that cooling fluid and calorically active material of the calorically active material element are operatively connected.

In a further alternative preferred embodiment of the invention, provision is made, in addition to the fluid return, of a fluid connection from the cold-side reservoir, which fluid connection conducts cooling fluid from the cold-side reservoir through the calorically active material element, or past the calorically active material element, to the cold-side reservoir such that cooling fluid and calorically active material of the calorically active material element are operatively connected.

The above-described object is likewise achieved by a heat-exchanger unit for a cyclic-process-based system. The heat-exchanger unit comprises, as is known per se, a calorically active material element with calorically active material, wherein the calorically active material is arranged so as to be operatively connected to a working fluid such that heat can be transferred between working fluid and calorically active material and the heat transfer between working fluid and calorically active material takes place substantially by means of latent heat transfer (that is to say evaporation heat and condensation heat of the working fluid).

It is essential that the heat-exchanger unit comprises a regulation device for control or regulation of a base temperature of the calorically active material element.

The heat-exchanger unit according to the invention likewise has the advantages of the method according to the invention that have already been mentioned. The method according to the invention likewise has all the advantages of the heat-exchanger unit according to the invention that are mentioned below.

In a possible preferred realization, the regulation device is designed as at least one fluid channel for the cooling fluid. The fluid channel runs operatively connected to the calorically active material. Preferably, the fluid channel runs to the calorically active material or through the calorically active material. In this way, the cooling fluid can be brought into operative connection with the calorically active material in a simple manner.

In a preferred embodiment of the invention, the calorically active material is in the form of rods, preferably in the form of hollow rods. Preferably, a plurality of rods, particularly preferably 2 to 100 rods, preferably 5 to 50 rods, particularly preferably 10 rods, are arranged as part of the heat-exchanger unit. Particularly preferably, the number and configuration of the rods are determined according to the total caloric material mass and also according to the surface-to-volume ratio, in order for it to be possible for heat to be discharged or fed to a sufficient extent. Preferably, a channel for the cooling fluid runs through each rod composed of calorically active material of the heat-exchanger unit.

Preferably, the cooling fluid is water, alcohol, butane, propane, $CO_2$, $NH_3$ or a mixture of the aforementioned fluids.

In a preferred embodiment of the invention, the regulation device comprises at least one pump for pumping the cooling fluid and/or at least one throttle. Both the pump and the throttle are arranged preferably in the fluid line for the cooling fluid, particularly preferably in the fluid return. A speed of the cooling fluid can be set by means of the pump and/or the throttle. The speed of the cooling fluid is used to control the amount of heat that is transferred from the calorically active material of the calorically active material element to the cooling fluid, that is to say the extent to which the cooling fluid cools the calorically active material.

The use of the pump and/or a throttle thus makes it possible for the base temperature to be controlled in a simple manner.

In an alternative embodiment, the working fluid is used as cooling fluid. Preferably, a fluid return of the cyclic-process-based system is arranged and configured in such a way that the working fluid in the fluid return is brought into operative connection with the calorically active material. Working fluid and cooling fluid are consequently no longer spatially separated. Rather, the working fluid is the cooling fluid. Consequently, provision is made of substantially only one fluid circuit for working fluid and cooling fluid. Here, two circuits of fluid lines may be provided. These two circuits, however, are connected, preferably via the hot-side reservoir and/or the cold-side reservoir. The working fluid is evaporated from the cold-side reservoir and is heated in the fluid chamber by the calorically active material. Consequently, the working fluid flows to the hot-side reservoir, where it condenses in the condenser region. The condensed working fluid is, as cooling fluid, returned by means of the fluid return to the cold-side reservoir in such a way that the working fluid is brought into operative connection with the calorically active material as cooling fluid in the calorically active material element.

This yields the advantage that the base temperature can be controlled without a complex design of fluid circuits.

In an alternative embodiment of the invention, the fluid return of the cyclic-process-based system is arranged and configured in such a way that the working fluid is guided as cooling fluid to the calorically active material by means of the fluid return such that wetting of a surface of the calorically active material takes place in the fluid chamber. Thus, the cooling fluid is not conducted through the calorically active material. Rather, the cooling fluid is used to wet the surface of the calorically active material in the fluid chamber. The additional evaporation heat due to the extra fluid thus allows the temperature of the calorically active material to be set. The fluid can in this case be fed within the system for example from the warm side, the cold side or another segment. The fluid may be fed in an actively controlled manner (pump, valve) or be conducted into the fluid chamber for example by way of a passively induced pressure gradient or under the action of gravitational force. Furthermore, the feeding of fluid may be regulated by way of programmable materials.

In order for the heat to be optimally discharged, the additional fluid must be distributed on the surface of the caloric material in order for heat to be discharged there by way of evaporation. This is preferably achieved through targeted adaptation of the wetting properties. Wetting surface properties can be achieved by means of chemical treatment of the surfaces. An enhancement of the effect is possible through additional microstructuring of the surface.

Preferably, the heat-exchanger unit is designed with a liquid circuit for the working fluid and a liquid circuit for the cooling fluid, which are in particular spatially separated.

The object according to the invention is likewise achieved by a device for transporting energy. The device for transporting energy is operable as a heat pump and/or cooling device and comprises, as is known per se, a hot-side reservoir and a cold-side reservoir for a working fluid. The device furthermore comprises at least one fluid chamber which is connected to the hot-side reservoir and the cold-side reservoir via fluid lines. At least one hot-side valve is provided between hot-side reservoir and fluid chamber, and at least one cold-side valve is provided between cold-side reservoir and fluid chamber. A calorically active material element with calorically active material is arranged in the fluid chamber, wherein the calorically active material is operatively connected to the working fluid such that heat can be transferred between working fluid and calorically active material by means of latent heat transfer. The device has means for generating an electric field and/or magnetic field and/or elastic field for the calorically active material such that the calorically active material is arranged in an interaction region of the field. A possible realization of such a device is described for example in DE 10 2015 121 657 A1.

It is essential that the device comprises a regulation device for control of a base temperature of the calorically active material element.

The device according to the invention for transporting energy likewise offers the above-described advantages of the method according to the invention and of the heat-exchanger unit according to the invention. The device according to the invention for transporting energy is suitable in particular for the use of the heat-exchanger unit according to the invention and/or of the preferred embodiments of the heat-exchanger unit according to the invention.

The object according to the invention is likewise achieved by a cooling device or a heat pump having a heat-exchanger unit, wherein the heat-exchanger unit comprises a calorically active material element with calorically active material. The calorically active material is arranged so as to be operatively connected to a working fluid such that heat can be transferred between working fluid and calorically active material, wherein the heat transfer between working fluid and calorically active material takes place substantially by means of latent heat transfer.

It is essential that the heat pump or the cooling device comprises a regulation device for control of a base temperature of the calorically active material element.

The method according to the invention and the heat-exchanger unit according to the invention are suitable in principle for applications in which heat is to be transported from a reservoir at a first temperature into a reservoir at a second temperature. The method according to the invention and the heat-exchanger unit according to the invention are therefore preferably designed as heat pumps or refrigeration machines or are used in heat pumps or refrigeration machines.

A particularly advantageous possible realization consists in an air-conditioning device, in particular in a cooling and air-conditioning unit. Known cooling and air-conditioning units generally work in a compressor-based manner and require a refrigerant. As is known, the refrigerants in this case are climate-damaging and harmful to the environment, and also highly flammable, and furthermore harmful to health. For this reason, cooling with the aid of the presented systems with calorically active materials is an interesting alternative to compressor-based systems. A disadvantage of the systems already known from the prior art is the relatively low efficiency. This efficiency is increased by way of the temperature stabilization according to the invention.

BRIEF DESCRIPTION OF THE DRAWINGS

Further preferred features and embodiments of the invention will be discussed below on the basis of exemplary embodiments and the figures.

In the figures.

DETAILED DESCRIPTION

In FIGS. 1 to 5, the same reference signs denote the identical or identically acting elements.

Figure 1:
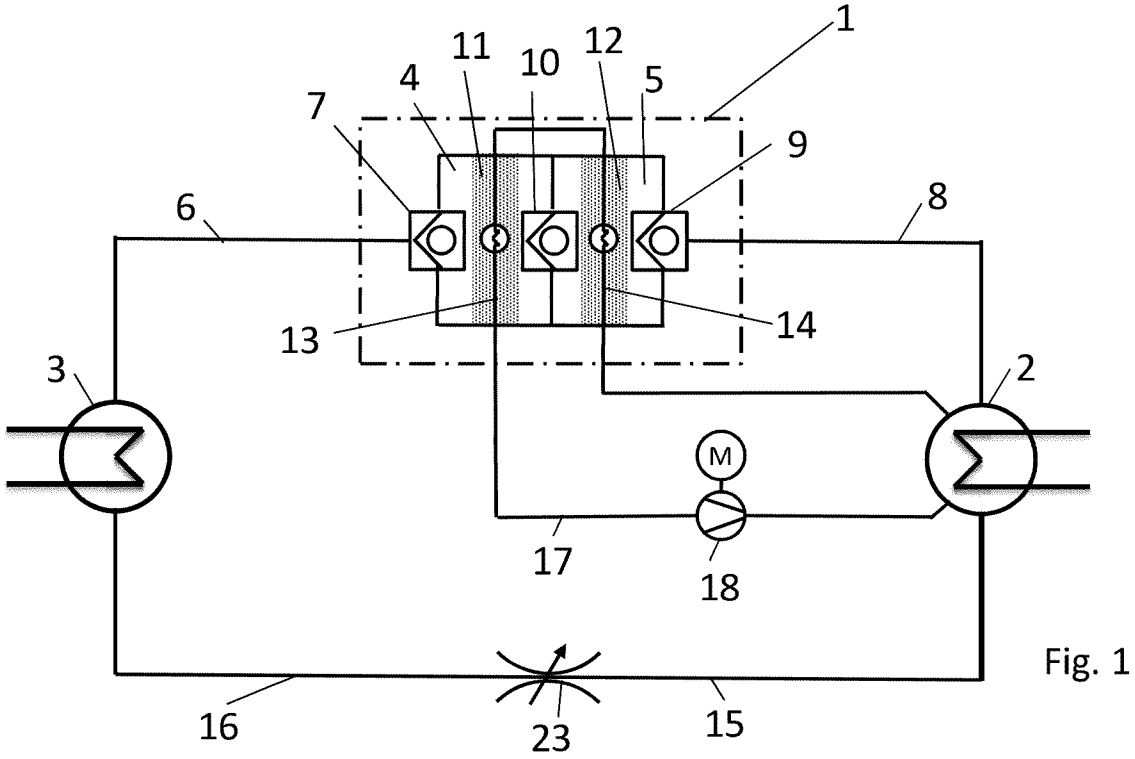
FIG. 1 shows a schematic illustration of a first exemplary embodiment of the invention, with internal flow through the heat-exchanger unit.

FIG. 1 shows a schematic illustration of a refrigeration machine according to the invention as a first exemplary embodiment. The refrigeration machine 1 is designed with a hot-side reservoir 2 and a cold-side reservoir 3 for a working fluid. In the present case, water is used as working fluid. In the present case, the cold-side reservoir has a temperature of 5° C. and a prevailing pressure of 8 mbar. In the present case, the hot-side reservoir 2 has a temperature of 35° C. and a prevailing pressure of 55 mbar.

Two fluid chambers 4, 5 are provided between cold-side reservoir 3 and hot-side reservoir 2. The first fluid chamber 4 is connected to the cold-side reservoir 3 via a fluid line 6. A cold-side valve 7 is arranged in the fluid line 6 between cold-side reservoir 3 and first fluid chamber 4. The cold-side valve 7 is designed as a check valve.

The second fluid chamber 5 is connected to the hot-side reservoir 2 via a fluid line 8. A hot-side valve 9 is arranged in the fluid line 8 between hot-side reservoir 2 and second fluid chamber 5. The hot-side valve 9 is designed as a check valve.

The first fluid chamber 4 and the second fluid chamber 5 are likewise connected to one another via a check valve 10. Arranged in the first fluid chamber 4 and in the second fluid chamber 5 is in each case one calorically active material element 11, 12. In the present case, the calorically active material elements 11, 12 are formed from mechanocaloric material, specifically a nickel-titanium alloy Ni55,8Ti44,2.

In the present case, a channel 13, 14 runs through the calorically active material of the calorically active material elements 11, 12. The cooling fluid for stabilization and/or control of the base temperature of the calorically active material elements 11, 12 is conducted through the channel. The cooling fluid thereby flows through the calorically active material elements 11, 12.

A fluid return 15 is arranged between hot-side reservoir 2 and cold-side reservoir 3. A throttle 23 is provided in the fluid return 15. The cooling apparatus 1 consequently has a first fluid circuit 16 for the working fluid. The fluid circuit 16 for the working fluid comprises the cold-side reservoir 3, the first fluid line 6, the first fluid chamber 4, the second fluid chamber 5, the second fluid line 8, the hot-side reservoir 2 and the fluid return 15. The fluid circuit 16 is designed as a pressure-tight system by virtue of substantially all foreign gases (that is to say all gases with the exception of the working fluid) having been removed from the pressure-tight system.

In the fluid circuit, as already described, the cold-side valve 7 is arranged between the cold-side reservoir 3 and the first fluid chamber 4 and the hot-side valve 9 is arranged between the hot-side reservoir and the second fluid chamber 5. In the present case, the cold-side valve 7 and the hot-side valve 9 are designed as pressure-controlled valves. The respective differential pressure at which the two valves open is settable, and in the present case is approximately 1 mbar.

In addition to the first fluid circuit 16 for the working fluid, a second fluid circuit 17 for the cooling fluid is provided. A pump (or compressor) 18 for controlling the throughflow of the cooling fluid is provided in the second fluid circuit 17.

The second fluid circuit 17 runs from the hot-side reservoir 2 to the first fluid chamber 4 via the pump 18. In the first fluid chamber 4, the second fluid circuit 17 runs through the first calorically active material element 11 by way of the first channel 13. In this way, the first calorically active material element 11 is flowed through internally by the cooling fluid. The fluid circuit 17 then runs onward to the second fluid chamber 5. Here, the second fluid circuit runs through the second calorically active material element 12 by way of the second channel 14. In this way, the second calorically active material element 12 is also flowed through internally by the cooling fluid. The second fluid circuit 17 then runs onward and back to the hot-side reservoir 2. The second fluid circuit 17 is consequently a fluid circuit which is connected to the first fluid circuit 16 via the hot-side reservoir 2. The working fluid of the first fluid circuit 16 is consequently used as cooling fluid of the second fluid circuit 17.

The speed of the cooling fluid can be controlled by means of the pump 18. Via the control of the speed, it is possible to set the amount of heat transferred from the first calorically active material element 11 and the second calorically active material element 12 to the cooling fluid, so that, in this way, the base temperature of the two calorically active material elements 11, 12 can be controlled.

Figure 2:
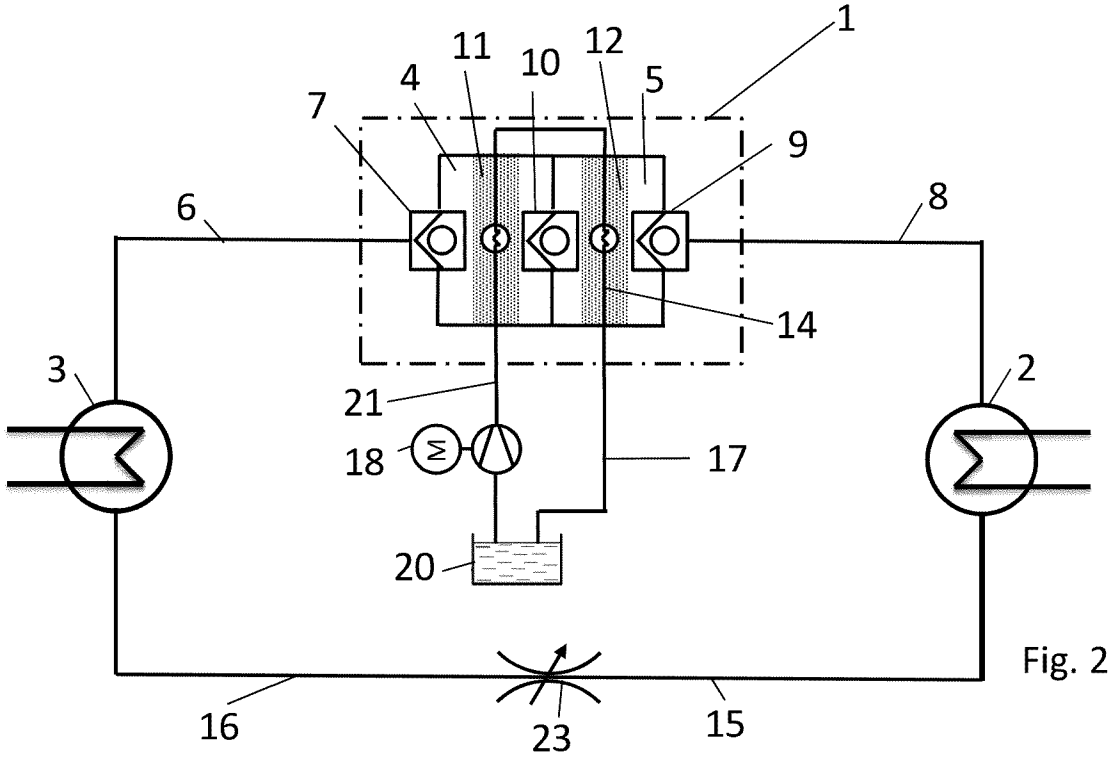
FIG. 2 shows a second exemplary embodiment of the invention, with internal flow through the heat-exchanger unit.

FIG. 2 shows a schematic illustration of a further exemplary embodiment of the invention, with a separate reservoir for the cooling fluid.

To avoid repetitions, only the differences with regard to FIG. 1 will be discussed below.

In the present case, two separate liquid circuits 16, 19 are provided for the cooling fluid and the working fluid. The working fluid flows, as described with regard to FIG. 1, in a liquid circuit 16 from the cold-side reservoir 3 to the hot-side reservoir 2 via the calorically active material elements 11, 12, and back to the cold-side reservoir 3 via the fluid return 15.

In the present case, the separate fluid circuit 19 for the cooling fluid is connected neither to the cold-side reservoir 3 nor to the hot-side reservoir 2. Rather, a separate cooling-fluid reservoir 20 for the cooling fluid is provided. From the cooling-fluid reservoir 20, a fluid line 21 runs to the first calorically active material element 11 with calorically active material. The cooling fluid flows through the first calorically active material element 11 by way of the channel 13, said channel running internally through the calorically active material of the first calorically active material element 11. From the first calorically active material element 11, the cooling fluid flows through the second calorically active material element 12 via the second channel 14. The channel 14 likewise runs in the interior of the calorically active material. In order for the second fluid circuit 19 to be closed, a fluid line leads from the channel 14 back to the cooling-fluid reservoir 20.

In the fluid circuit 19, a pump 18 is provided in the fluid line 21 between cooling-fluid reservoir 20 and channel 13. The speed of the cooling fluid in the fluid circuit 19 can be controlled by the pump 18. Via the speed, as described with regard to FIG. 1, the base temperature of the two calorically active material elements 11, 12 can be controlled.

The separate fluid circuit 19 for the cooling fluid is consequently a closed fluid circuit which is spatially separated from the first fluid circuit 16 for the working fluid.

Figure 3:
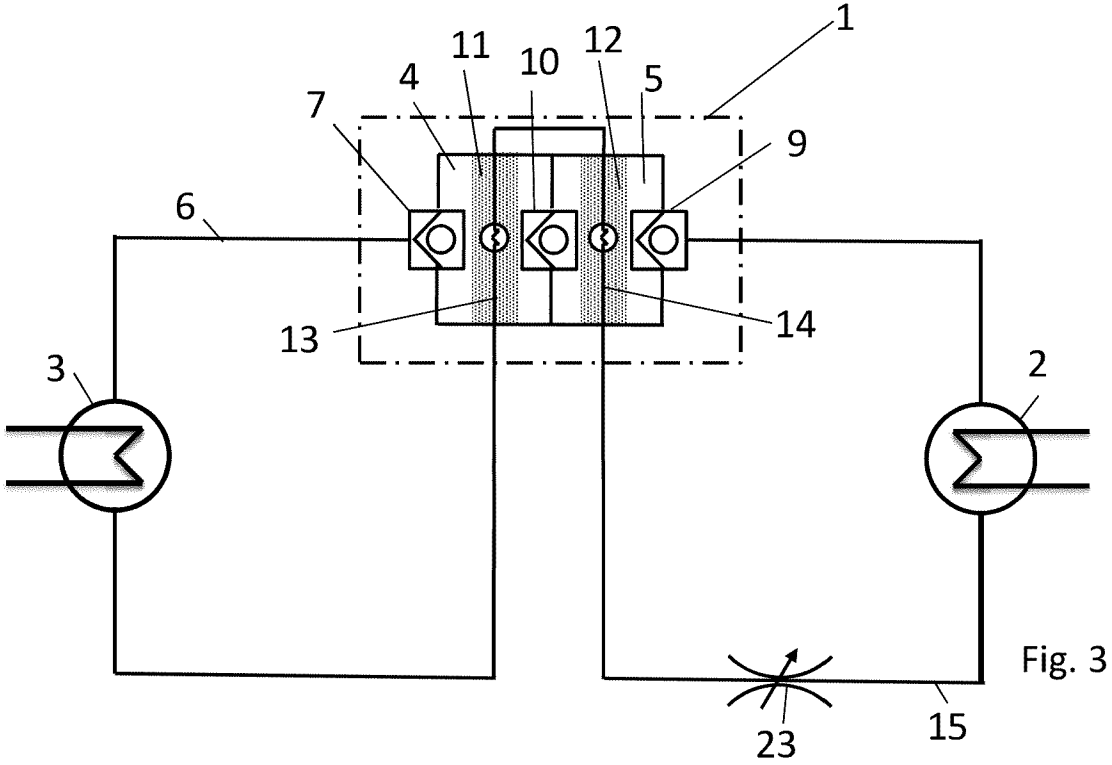
FIG. 3 shows a third exemplary embodiment of the invention, with internal flow through the heat-exchanger unit.

FIG. 3 shows a schematic illustration of a further exemplary embodiment of the invention.

In the present case, the fluid return 15 is designed in such a way that the fluid return 15 runs through the calorically active material element 12 via the channel 14 and through the calorically active material element 11 by way of the channel 13. The fluid return 15 runs from the hot-side reservoir to the cold-side reservoir 3.

A throttle 23 is provided in the fluid line of the fluid return 15 between the hot-side reservoir 2 and the channel 14 through the calorically active material element 12. By way of the throttle 23, the speed of the cooling fluid can be set, so that the amount of heat that is transferred from the calorically active material elements 12 and 11 to the cooling fluid can be controlled.

Figure 4:
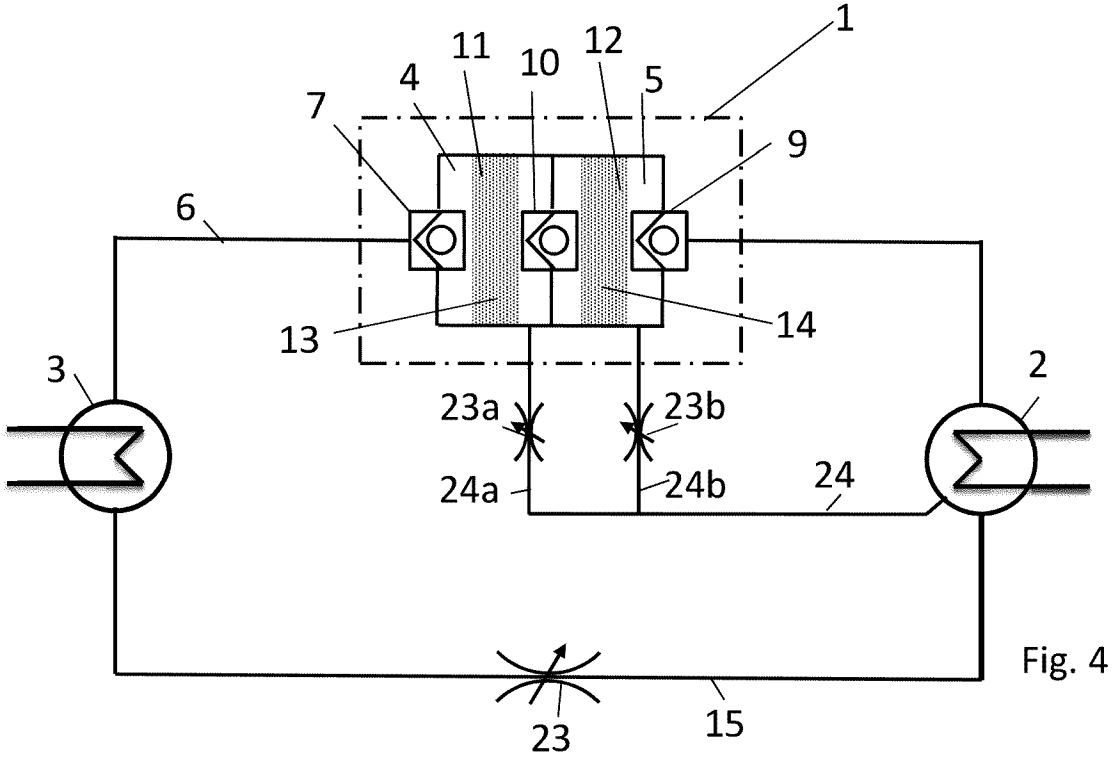
FIG. 4 shows a schematic illustration of a fourth exemplary embodiment of the invention, with wetting of the surface of the heat-exchanger unit.

FIG. 4 shows a schematic illustration of a further exemplary embodiment of the invention, with wetting of the surface of the calorically active material by the cooling fluid.

The first fluid circuit 16 is designed with the fluid return 15 as described with regard to FIGS. 1 and 2.

From the hot-side reservoir 2, a fluid line 24 leads to the fluid chambers 4, 5. The fluid line 24 is divided into two fluid lines 24*a*, 24*b*, each of which ends at that side of the fluid chambers 4, 5 which faces toward the hot-side reservoir. In the two fluid lines, there is provided in each case one throttle 23*a*, 23*b* by way of the fluid lines 24*a*, 24*b*, the cooling fluid is fed to the two fluid chambers 4, 5 in such a way that a surface of the calorically active material elements 11, 12 that faces toward the hot-side reservoir 2 is in each case wetted by the cooling fluid. The additional cooling fluid, which is available in addition to the working fluid in the fluid chamber 4, 5, results in a higher degree of evaporation and thus in a higher degree of removal of heat. In this way, the temperature of the calorically active material elements 11, 12 can be set.

Figure 5:
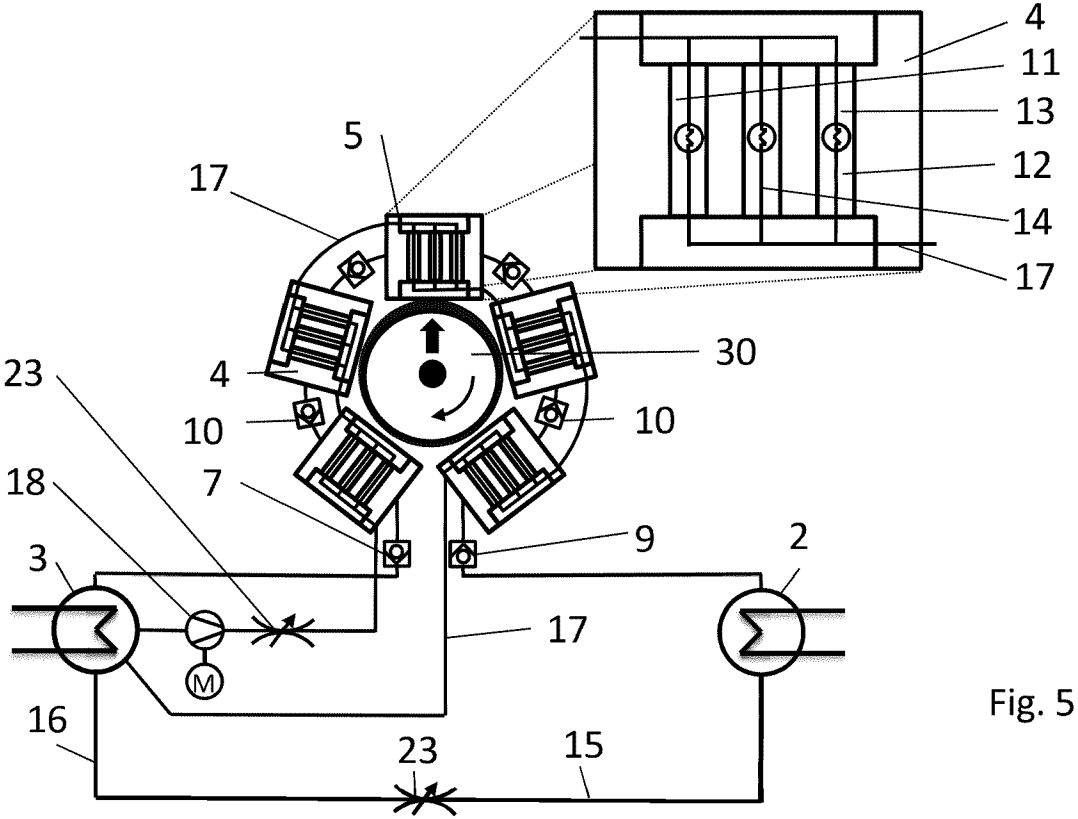
FIG. 5 shows a schematic illustration of a sixth exemplary embodiment of the invention in the form of a cooling system.

FIG. 5 shows a schematic illustration of an exemplary embodiment of a cyclic-process-based system according to the invention, in the present case a cooling device.

The cooling device comprises multiple fluid chambers, in the present case five fluid chambers. The fluid chambers 4, 5 are arranged in a circular manner around a center. An eccentric 30 is provided in the center. The fluid chambers are denoted by way of example by 4, 5. The fluid chambers 4, 5 are connected to one another via check valves. Calorically active material elements 11, 12, in the present case hollow rods composed of mechanocaloric material, are provided in the fluid chambers 4, 5. In the present case, multiple fluid chambers 4, 5 are connected in series. The calorically active material elements 11, 12 are subjected to pressure by means of the eccentric 30. This results in the mechanocaloric material of the calorically active material elements 11, 12 being heated. As a result of the change in temperature, the fluid in the fluid chamber 4, 5 evaporates and flows into the next fluid chamber via the check valve. The arrows indicate the "movement direction" of the working fluid, in the present case counter clockwise. The heat is also transported in this direction. The working fluid flows through the fluid chambers 4, 5 connected in series. With each fluid chamber 4, 5, the temperature of the working fluid changes.

The devices, for temperature regulation, are adapted in such a way that the temperature of the calorically active material elements 11, 12 is in each case set to the ideal working temperature in the respective fluid chamber 4, 5.

The fluid chamber 5 is illustrated on an enlarged scale as a detail. Three hollow rods composed of mechanocaloric material, denoted by way of example by 11, 12, are provided in the fluid chamber 5 and have in each case one channel, denoted by way of example by 13, 14. The cooling fluid flows through the calorically active material via the fluid circuit 17.

LIST OF REFERENCE SIGNS

1 Cooling device
2 Hot-side reservoir
3 Cold-side reservoir
4 Fluid chamber
5 Fluid chamber
6 Fluid line
7 Cold-side valve
8 Fluid line
9 Hot-side valve
10 Check valve
11 Calorically active material element
12 Calorically active material element
13 Channel
14 Channel
Fluid return
16 1st fluid circuit
17 2nd fluid circuit
18 Pump
19 Fluid circuit
20 Cooling-fluid reservoir
21 Fluid line
23 Throttle
23*a* Throttle
23*b* Throttle
24*a* Fluid line
24*b* Fluid line
30 Eccentric

The invention claimed is:

1. A method for operating cyclic-process-based systems having a hot-side reservoir (2) and a cold-side reservoir (3) and at least one fluid chamber (4, 5), having an evaporator region and a condenser region for a working fluid and having at least one heat-exchanger unit with at least one calorically active material element (11, 12), the calorically active material element (11, 12) being arranged in the fluid chamber (4, 5) so as to be indirectly or directly operatively connected to the working fluid and a heat transfer between the calorically active material of the calorically active material element (11, 12) and the working fluid takes place by latent heat transfer, the method comprising the following steps:

A activating a field that is adapted to cause a change in temperature of the calorically active material such that the calorically active material is at least temporarily subjected to interaction with the field;

B evaporating the working fluid through heating of the calorically active material by a first change in temperature, induced in method step A, of the calorically active material to above a base temperature;

C discharging the working fluid to the hot-side reservoir (2) and condensing the working fluid at the condenser region, realizing heat transport by latent heat of the evaporated working fluid;

D return transporting the condensed working fluid from the condenser region to the evaporator region;

E deactivating the field;

F causing a second, opposite change in temperature of the calorically active material to below the base temperature;

G feeding of the working fluid from the cold-side reservoir (3) into the fluid chamber, wherein heat transport from the evaporator region into the fluid chamber is realized by latent heat of the evaporated working fluid; and H controlling or regulating the base temperature of the calorically active material element using a cooling fluid.

2. The method as claimed in claim 1, wherein a plurality of the fluid chambers (4, 5) are provided that are connected in series or parallel such that the working fluid flows through the fluid chambers (4, 5) that are connected in series or parallel and the method further comprises repeating steps A-H cyclically in the fluid chambers that are connected in series or parallel.

3. The method as claimed in claim 1, wherein using the cooling fluid, the base temperature of the calorically active material element (11, 12) is adapted to an ideal working temperature for the calorically active material.

4. The method as claimed in claim 1, wherein the working fluid and the cooling fluid are spatially separated.

5. The method as claimed in claim 1, further comprising conducting the cooling fluid through the calorically active material element (11, 12).

6. The method as claimed in claim 1, further comprising using the working fluid as the cooling fluid such that the cooling fluid and the calorically active material of the calorically active material element (11, 12) are operatively connected.

7. The method as claimed in claim 1, wherein the calorically active material is exposed to the field, wherein the field is generated in the calorically active material as a mechanical stress, that causes a change in temperature of the calorically active material, the field is generated by an electrical capacitor that causes a change in temperature of the calorically active material, or the field is generated by a permanent magnet that causes a change in temperature of the calorically active material.

8. A heat-exchanger unit for a cyclic-process-based system with a hot side reservoir (2) and a cold side reservoir (3) and at least one fluid chamber (4, 5), an evaporator region, and a condenser region for a working fluid, the heat-exchanger unit comprising:

at least one calorically active material element (11, 12) with calorically active material, the calorically active material is arranged operatively connected to the working fluid such that heat is transferrable from the cold side reservoir to the hot side reservoir by latent heat transfer, with the heat being transferrable between the working fluid and the calorically active material and the heat transfer between the working fluid and the calorically active material takes place by latent heat transfer via evaporation and condensation heat, and the heat-exchanger unit comprises a regulation device configured to control or regulate a base temperature of the calorically active material element.

9. The heat-exchanger unit as claimed in claim 8, wherein the regulation device comprises at least one fluid channel (13, 14) for a cooling fluid operatively connected to the calorically active material.

10. The heat-exchanger unit as claimed in claim 9, wherein the cooling fluid comprises at least one of water, alcohol, butane, propane, $CO_2$, $NH_3$ or a mixture thereof.

11. The heat-exchanger unit as claimed in claim 9, wherein the regulation device comprises at least one of a pump (18) for pumping the cooling fluid or a throttle (23).

12. The heat-exchanger unit as claimed in claim 9, wherein the working fluid is used as the cooling fluid via a fluid return (15) of the cyclic-process-based system being configured such that the working fluid in the fluid return (15) is brought into operative connection with the calorically active material.

13. The heat-exchanger unit as claimed in claim 9, wherein a fluid return (15) of the cyclic-process-based system is configured such that the working fluid is guided to the calorically active material by the fluid return (15) such that wetting of a surface of the calorically active material takes place in a fluid chamber.

14. The heat-exchanger unit as claimed in claim 9, further comprising a liquid circuit (16) for the working fluid that is formed spatially separated from a liquid circuit (17) for the cooling fluid.

15. A device for transporting energy, operable as at least one of a heat pump or cooling device, comprising a hot-side reservoir (2) and a cold-side reservoir (3) for a working fluid, at least one fluid chamber (4, 5) which is connected to the hot-side reservoir (2) and the cold-side reservoir (3) via fluid lines (6), an evaporator region and a condenser region for a working fluid, at least one hot-side valve (9) between the hot-side reservoir (2) and the fluid chamber (4, 5) and at least one cold-side valve (7) between the cold-side reservoir (3) and the fluid chamber (4, 5), a calorically active material element (11, 12) with calorically active material arranged in the fluid chamber (4, 5) and the calorically active material is arranged operatively connected to the working fluid such that heat is transferrable from the cold-side reservoir (3) to the hot-side reservoir (2) by latent heat transfer, and the heat is transferrable between the working fluid and the calorically active material by latent heat transfer via evaporation and condensation heat, a device configured to generate a field that is adapted to cause a change in temperature of the calorically active material for the calorically active material such that the calorically active material is arranged in an interaction region of the field, and a heat-exchanger unit that includes the at least one calorically active material element (11, 12) and a regulation device configured to control or regulate a base temperature of the calorically active material element.

16. A cooling device comprising the heat-exchanger unit of claim 8.

17. A heat pump comprising the heat-exchanger unit of claim 10.

18. The method of claim 3, wherein a plurality of the fluid chambers (4, 5) are connected in series or parallel and the base temperature of the calorically active material element (11, 12) of the fluid chambers (4, 5) connected in series or parallel is adapted to the ideal working temperature for the calorically active material of the respective fluid chamber (4, 5).

19. The method of claim 6, further comprising providing a fluid connection from the cold-side reservoir (3) for conducting the cooling fluid through the calorically active material element (11, 12), or past the calorically active material element (11, 12), such that the cooling fluid and the calorically active material of the calorically active material element (11, 12) are operatively connected.

20. The method as claimed in claim 1, wherein the fields is an electric field, a magnetic field, or a mechanical stress a field.

21. The device pf claim 15, wherein the fields is an electric field, a magnetic field, or a mechanical stress a field.

* * * * *